United States Patent [19]

Dazzi

[11] Patent Number: 4,615,322

[45] Date of Patent: Oct. 7, 1986

[54] METHOD AND APPARATUS FOR CONTROLLING FUEL INJECTION

[75] Inventor: Jean-Louis Dazzi, Saint Genis Laval, France

[73] Assignee: Renault Vehicules Industriels, Lyons, France

[21] Appl. No.: 475,808

[22] Filed: Mar. 16, 1983

[30] Foreign Application Priority Data

Mar. 16, 1982 [FR] France ..... 82 04789

[51] Int. Cl.[4] ..... F02M 39/00

[52] U.S. Cl. ..... 123/506; 123/458; 123/451

[58] Field of Search ..... 123/446, 445, 458, 506, 123/451

[56] References Cited

U.S. PATENT DOCUMENTS 2,827,030 3/1958 Strumbos ..... 123/451

3,851,635 12/1974 Murtin ..... 123/458

4,132,201 1/1979 Bart ..... 123/451

4,449,507 5/1984 Mayer ..... 123/458

4,462,369 7/1984 Dazzi et al. ..... 123/451

*Primary Examiner*—Carl Stuart Miller

*Attorney, Agent, or Firm*—Remy J. VanOphem

[57] ABSTRACT

A method of controlling injection timing and an apparatus using the method. The method includes the steps of transmitting a first pulse to a first valve member movably disposed in an injector nozzle holder, moving the first valve member in response to the first pulse to bring first predetermined passageways into registry to initiate an injection cycle, transmitting a second pulse to a second valve member coaxially disposed relative to the first valve member and moving the second valve member in response to the second pulse to bring second predetermined passageways into registry to end an injection cycle.

20 Claims, 11 Drawing Figures

19

23
5a
4a
17
35
44
34
43
12
33
42
32
41
48
15
21
6a
3a

METHOD AND APPARATUS FOR CONTROLLING FUEL INJECTION

BACKGROUND OF THE INVENTION

1. Field of the Present Invention

The present invention relates to a novel method and apparatus for controlling the start and the end of a cycle of injection of fuel into the cylinder of a diesel engine.

2. Description of the Prior Art

Devices where the start of injection cycles and the end of injection cycles are both controlled by hydraulic means are known, for example from French Pat. No. 7,931,353 filed on Dec. 14, 1979, in the name of the present applicant under the title "Fuel injection device for an internal combustion engine". This known system uses a first slide valve for controlling the start of injection and a second slide valve for controlling the end of injection.

The control of these two slide valves is insured by means of micro-electrovalves tripped by an electronic computer.

Experience has shown that this known device operates satisfactorily but has the disadvantage of taking up a large amount of space, while requiring an entirely different arrangement of the injection elements as a whole from that of the conventional devices.

SUMMARY OF THE PRESENT INVENTION

The primary object of the present invention is avoiding these disadvantages by providing hydraulic or other appropriate control for the start of an injection cycle, and in particular permitting the use of an injector nozzle holder which is not substantially modified, as compared with conventional injection nozzle holders.

The method and apparatus of the present invention is for controlling the start and end of the cycle of injection of fuel into the cylinder of a diesel engine. An injector nozzle holder controls the closing of an injector in a known manner when high pressure is sent to the top of the latter, whereas when this high pressure stops, the injector opens. A movable sleeve and an independently movable central slide valve are concentrically disposed within the injector nozzle holder, and are capable of sliding relative to each other and relative to a fixed peripheral sleeve, under the action of hydraulic impulses distributed by way of micro-electrovalves actuated by an electronic computer.

Several modifications are possible from the above described method and apparatus. For example, the system can be organized so that after each injection cycle, the central slide valve and the movable sleeve return to the same rest position, that is, each of them describes a motion back and forth for each injection cycle. Alternatively, it may be provided that an injection cycle is ended after each single stroke of the movable sleeve and of its central slide valve. In this case, two successive injection cycles are described for each motion back and forth of the sleeve and of the slide valve.

BRIEF DESCRIPTION OF THE DRAWINGS

The many objects, features, and advantages of the present invention will become apparent to those skilled in the art when the following detailed description is read together with the attached drawings wherein the drawings annexed hereto are given as a nonlimiting example and will make it possible to better understand the characteristics of the invention.

DETAILED DESCRIPTION OF THE PREFERRED EMBODIMENT

Figure 1:
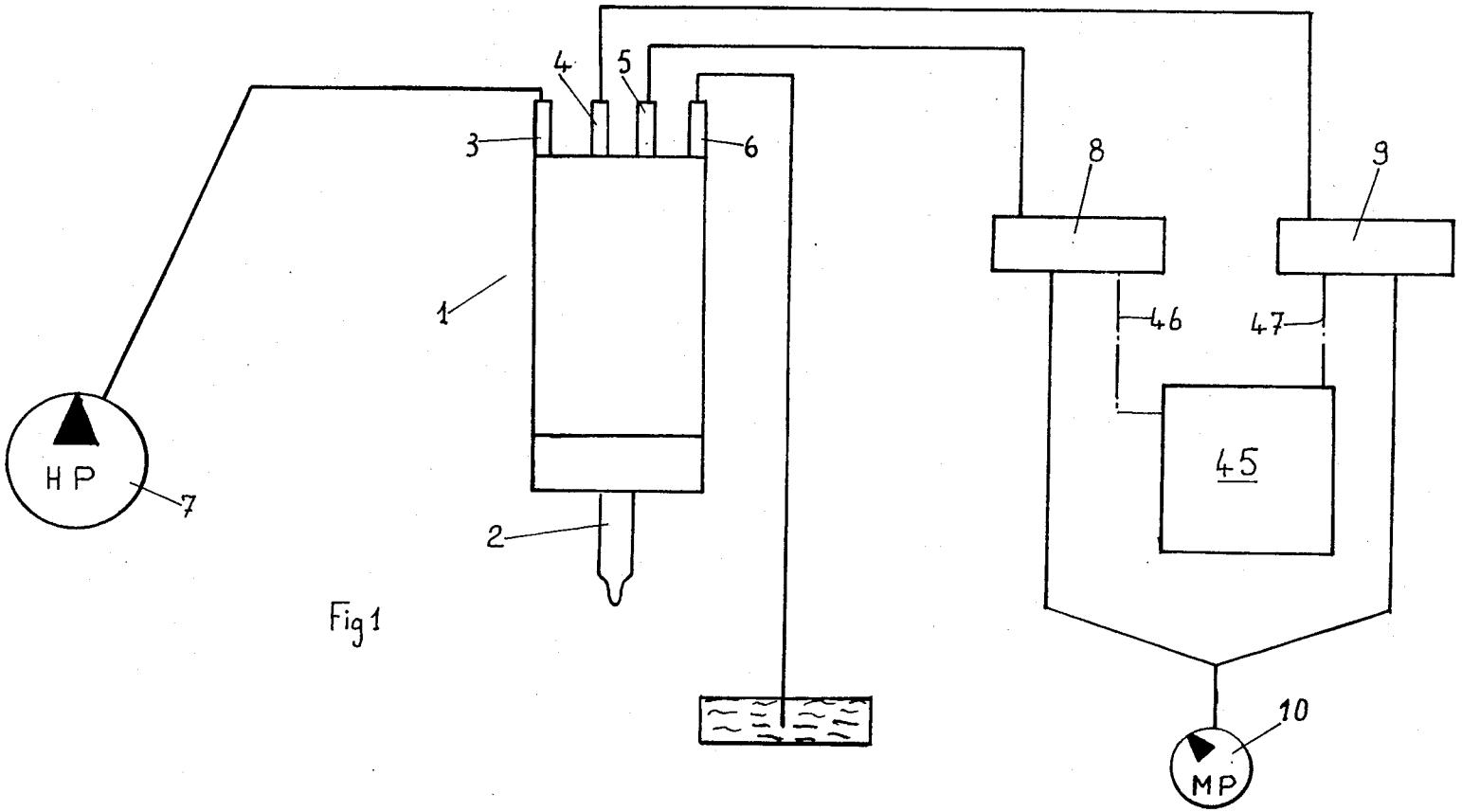
FIG. 1 is a diagram illustrating the organization of a system of injection according to the invention.

The diagram of FIG. 1 represents an injector nozzle holder 1 equipped with an injector 2, the assembly being mounted in a known manner in the cylinder head of a diesel engine, for injecting into the cylinder the desired portion of fuel for each engine cycle.

The injector nozzle holder 1, according to the present invention, has four fluid connections 3 through 6 at its upper portion. The connection 3 provides for the connection of a high pressure pump 7 to a passageway 3*a* in the injector nozzle holder 1. The pump 7 delivers fuel at a constant pressure, which may be of the order of 700 to 1000 bars. The connections 4 and 5 are used to supply the respective passageways 4*a* and 5*a* with a fuel at moderate pressure, for example, of the order of 120 bars, from two electrovalves 8 and 9 receiving the fuel from a pump 10 with moderate pressure. The connection 6 is for discharging the fuel pressure from an outlet passageway 6*a*.

Figure 2:
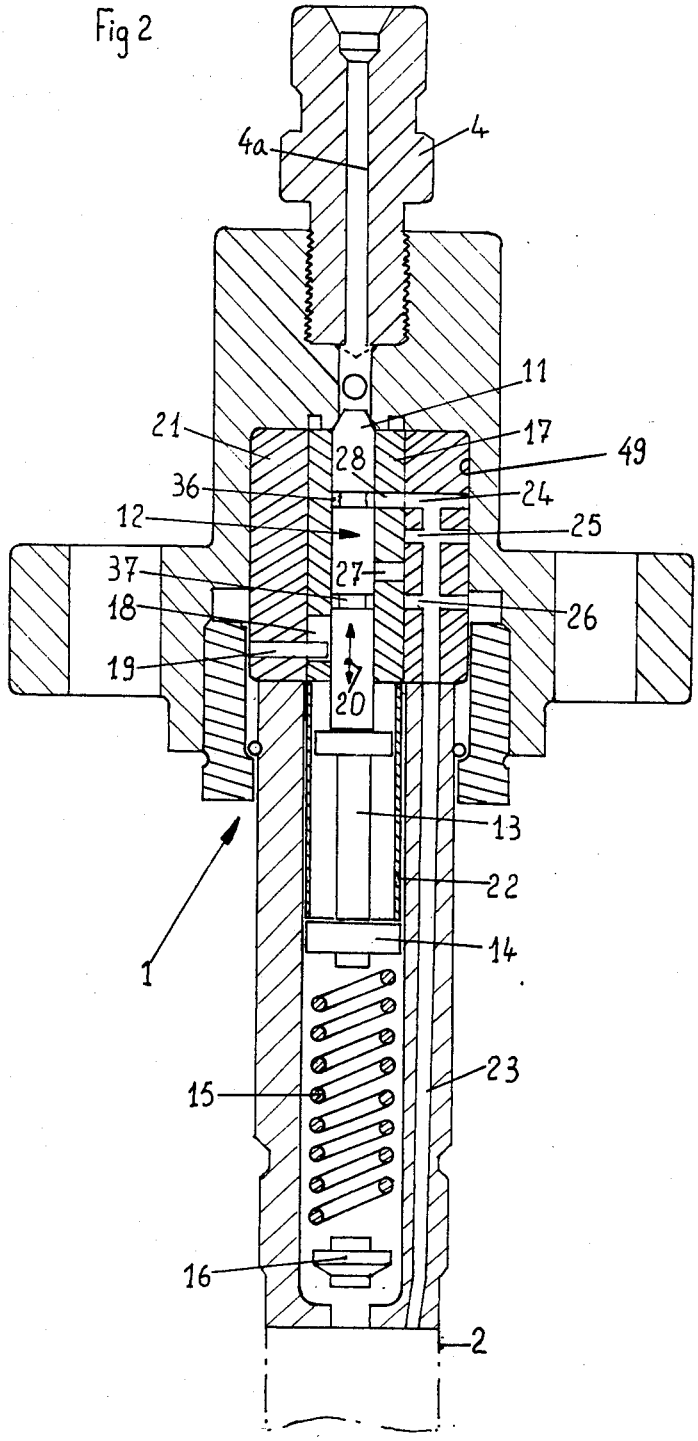
FIG. 2 is an axial section of an injector nozzle holder showing the arrangement of the fixed sleeve, of the moving sleeve, and of the central slide valve thereof.
Figure 4:
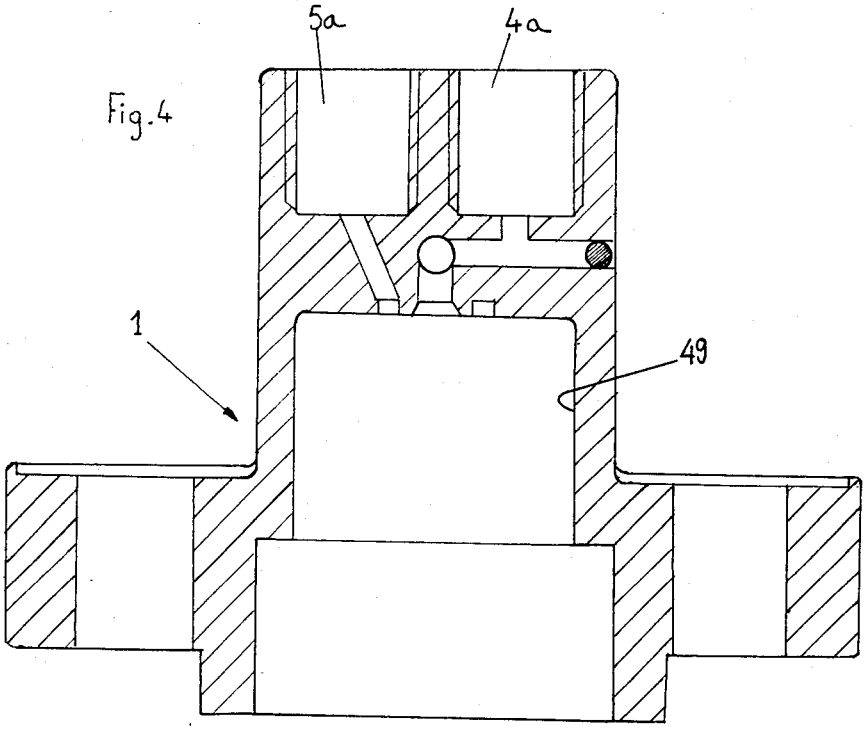
FIGS. 4 and 5 are partial sections taken, respectively, along lines IV—IV and V—V of FIG. 3.
Figure 3:
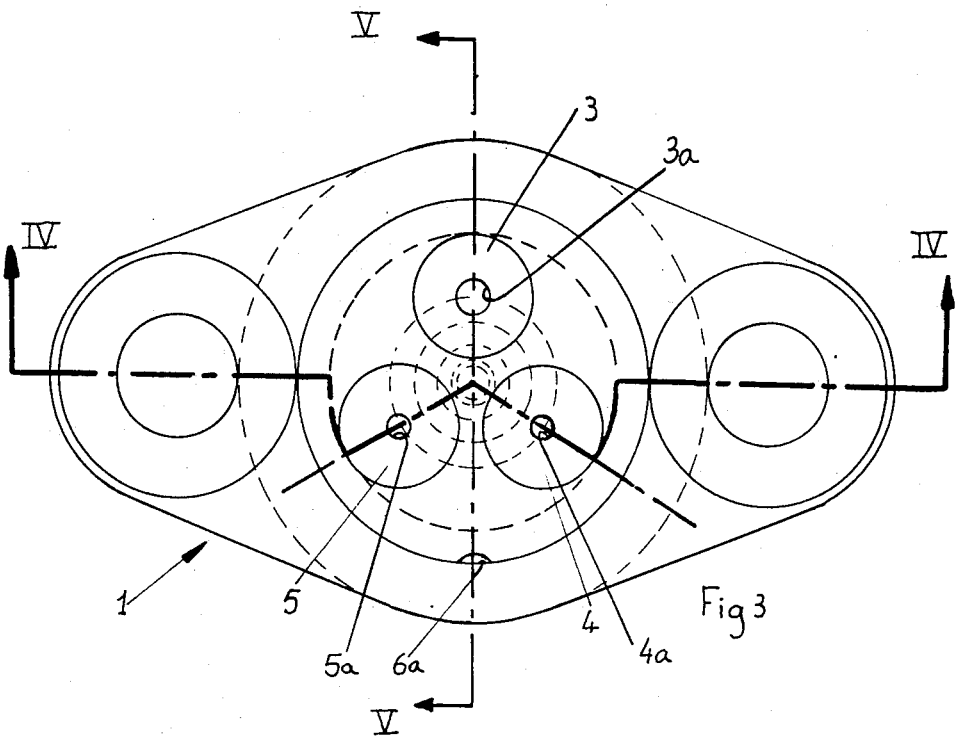
FIG. 3 is a plan view of the injector nozzle of FIG. 2.
Figure 5:
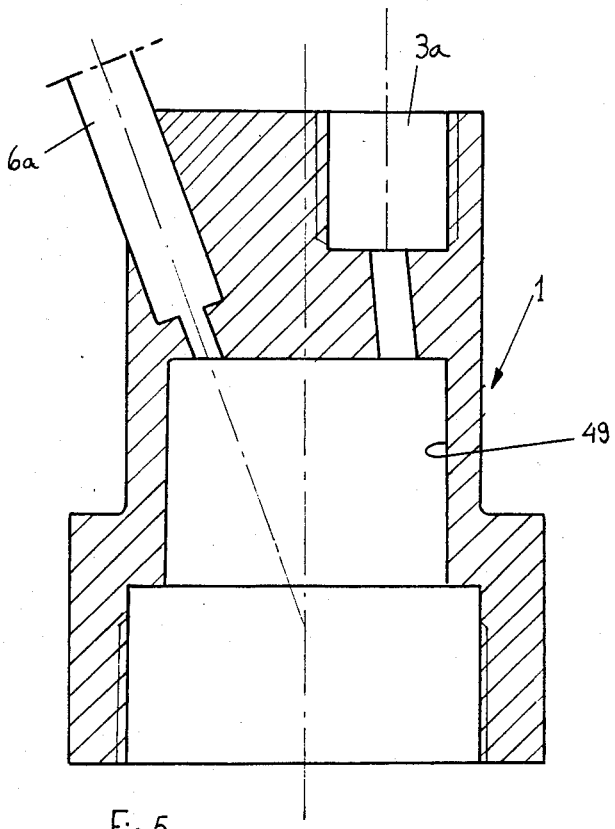

Inside the injector nozzle holder 1, as shown in FIG. 2, the connection 4 supplied with moderate pressure empties into the end 11 of a central slide valve 12. The central slide valve 12 has annular grooves positioned in a spaced apart relationship. The annular grooves may be two in number as shown by reference numerals 37 and 38 in FIG. 2. Alternatively, they can be three in number as shown by reference numerals 38, 39, and 40 in FIGS. 10 and 11; or four in number, as shown by reference numerals 41, 42, 43, and 44 in FIGS. 6 through 9. The central slide valve is supported by way of a shuttle 13 on a support part 14 with which a compression spring 15 is held on an injection valve 16.

Around the slide valve 12 there is a reciprocably movable tubular sleeve 17 provided with an elongated lateral opening 18 capable of moving in an axial direction relative to a fixed indexing pin 19. The latter prevents the sleeve 17 from rotating around its central axis and limits the amplitude of its movements in an axial direction, shown diagrammatically by the double arrow 20.

The pin 19 is integral with a fixed sleeve 21 seated on a bore 49 in the body of the injector nozzle holder 1.

A movable tubular brace 22 is disposed between the end of the movable sleeve 17 and the support part 14.

A line 23 connects the top of the injector 2 to the high pressure feed in a known manner. According to the invention, the top of the line 23 ends in the fixed sleeve 21. Transverse bores, such as 24, 25, and 26, cross the line 23 and open into the bore of the fixed sleeve 21 where the movable sleeve 17 slides. The movable sleeve moreover has bores passing through its whole thickness. These bores, may be two in number as shown by reference numbers 27 and 28 in FIG. 2. Alternatively they can be three in number, as shown by reference numbers 29, 30 and 31 in FIGS. 10 and 11 or four in number, as shown by reference numbers 32, 33, 34 and 35 in FIGS. 6 to 9.

Their operation is as follows:

The pump 7 continually delivers high pressure to the connection 3. An electronic computer 45, is supplied at a plurality of inputs, not shown, which deliver information relating to various parameters of operation of the motor as well as the instructions of the driver. The electronic computer 45 is connected by electric lines 46 and 47 to the electrovalves 8 and 9. As a function of commands given by the computer 45, each of the electrovalves 8 and 9, fed by the pump 10 with moderate pressure, sends hydraulic impulses with moderate pressure into the fluid connections 4 and 5. These hydraulic impulses cause the sliding motion of the central slide valve 12 and of the movable sleeve 17, relative both to one another and to the fixed sleeve 21.

As indicated previously, the start of injection is caused when the line 23 above the injector 2 is connected to the outlet passageway 6*a* while, on the contrary, the end of injection is caused by connecting this same line 23 to the high pressure feed passageway 3*a*.

Figure 6:
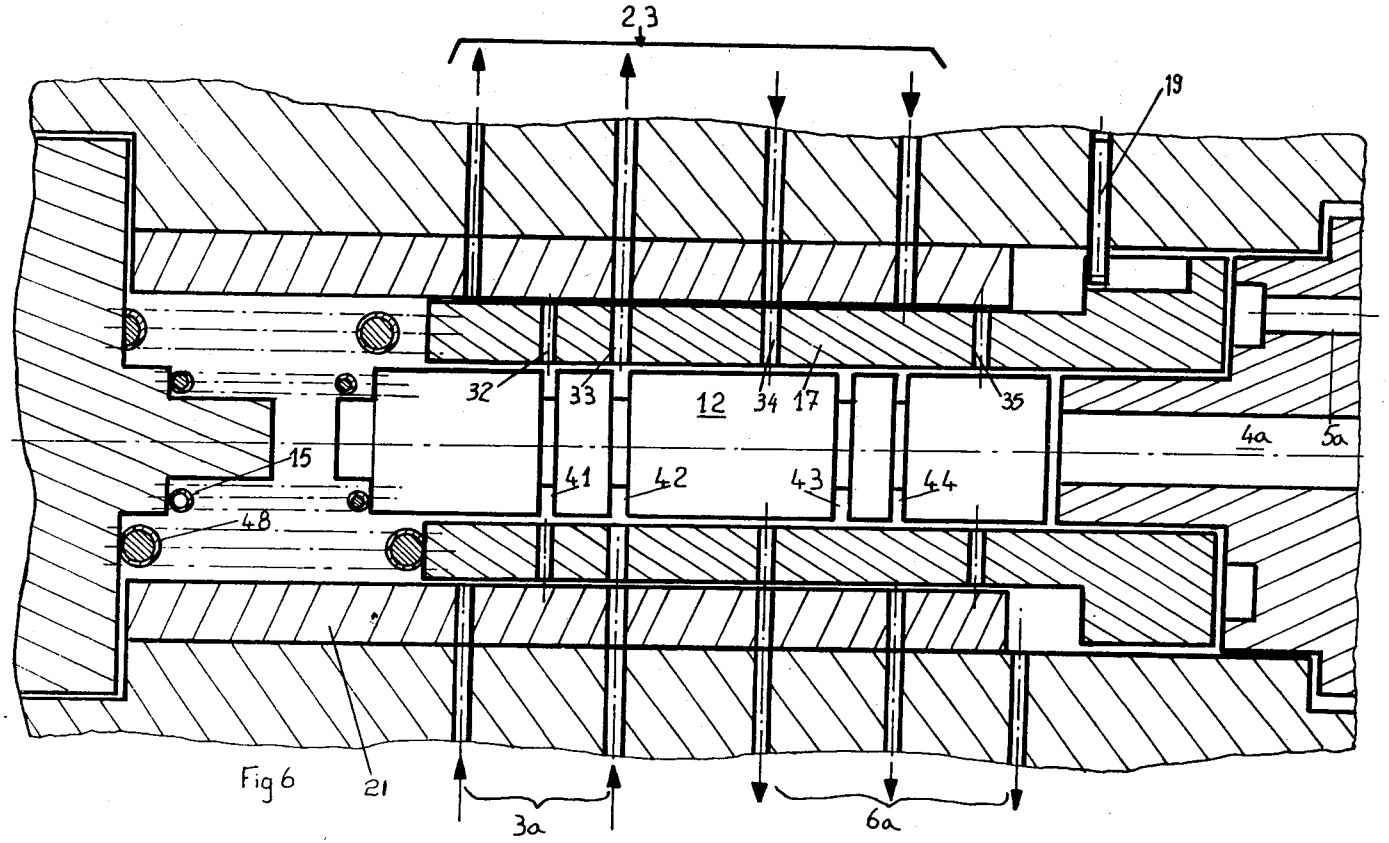
FIGS. 6 to 8 are diagrams corresponding to FIG. 2 and illustrating the relative motions of the moving sleeve and of the central slide valve.
Figure 7:
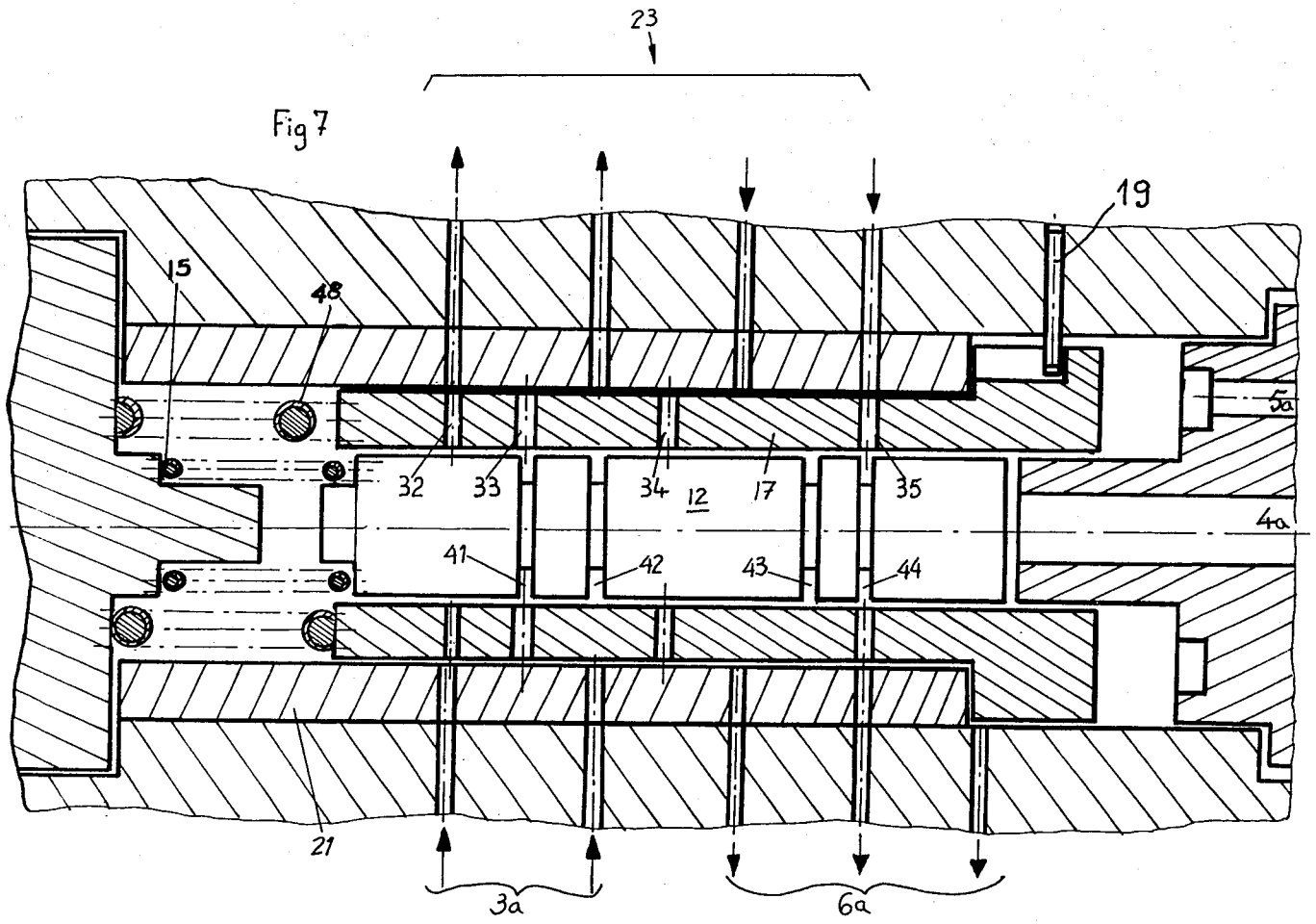
Figure 8:
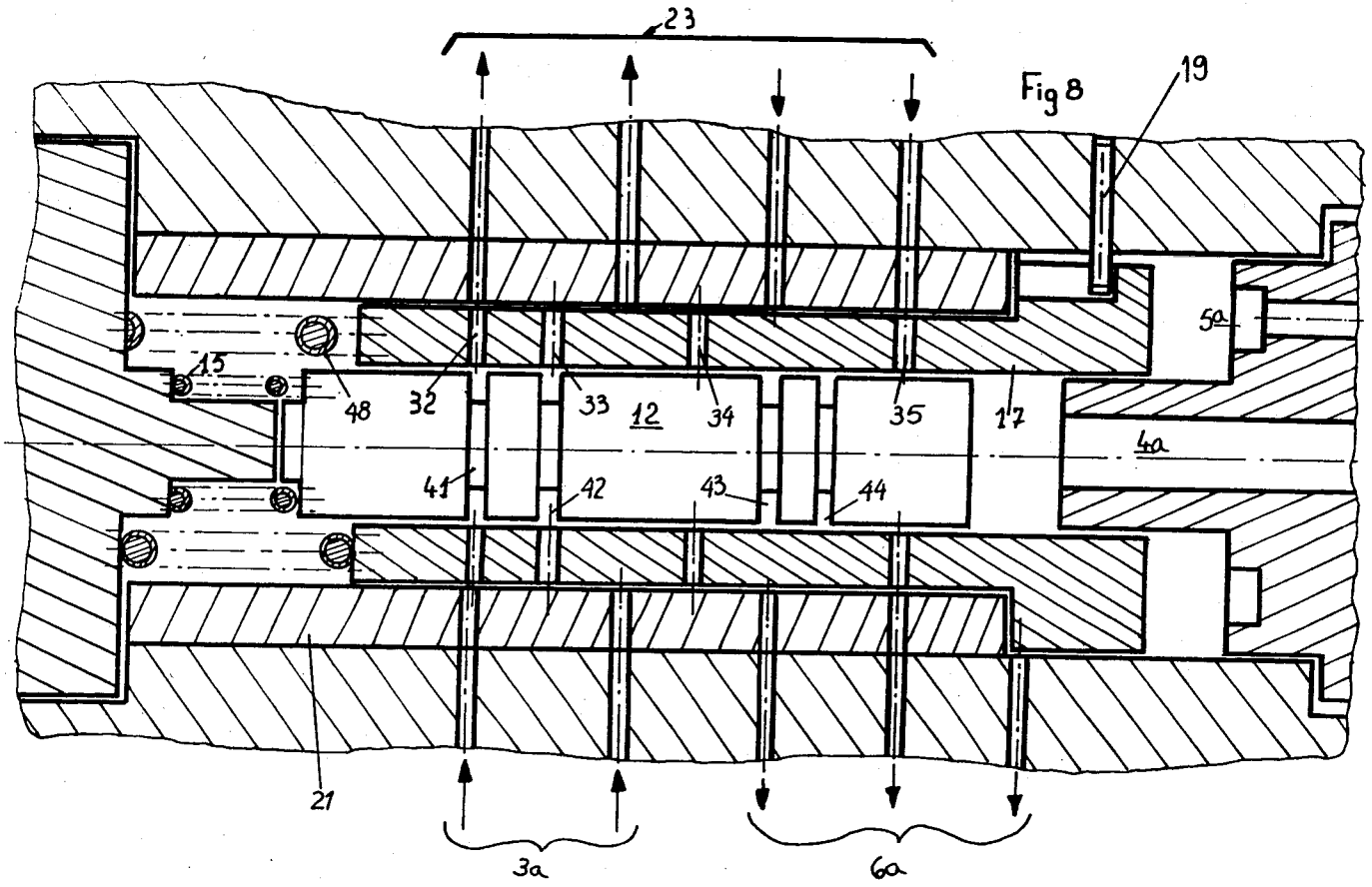

Refer now to the example of structure illustrated in FIGS. 6 to 8. FIG. 6 depicts the rest position which corresponds to the end of an injection cycle. In this case, the movable sleeve 17 and the central slide valve 12 are subjected only to the action of their respective springs 15 and 48. No pressure impulse is sent into the passageways 4*a* and 5*a*. The high pressure passageway 3*a* selectively communicates with the line 23 by way of the annular groove 42 of the central slide valve 12 and the corresponding bores 33 of the movable sleeve 17.

In the case of FIG. 7, a moderate pressure pulse has been sent by the electrovalve 8 into the passageway 5*a*, so that the movable sleeve 17 becomes pushed back to the left against the force of the spring 48. The line 23 becomes connected to the outlet passageway 6*a* by way of the annular groove 44 located so as to register with the bores 35 of the movable sleeve 17.

In the case of FIG. 8 a moderate pressure impulse is in turn sent by the electrovalve 9 into the passageway 4*a*, so that the central slide valve 12 also moves toward the left against the force of the spring 15. This time, the line 23 becomes connected to the high pressure passageway 3*a* by way of the annular groove 41 situated facing the bores 32 of the movable sleeve 17; this impulse by the electrovalve 9 defines the end of an injection cycle.

In the example of structure which has just been described, it is seen that a complete injection cycle of the motor is defined by a single motion, corresponding to a motion to the left as depicted in the drawing, first of the movable sleeve 17, then of the central slide valve 12. This arrangement makes it possible to reduce to the minimum the length of the high pressure pipes.

Figure 9:
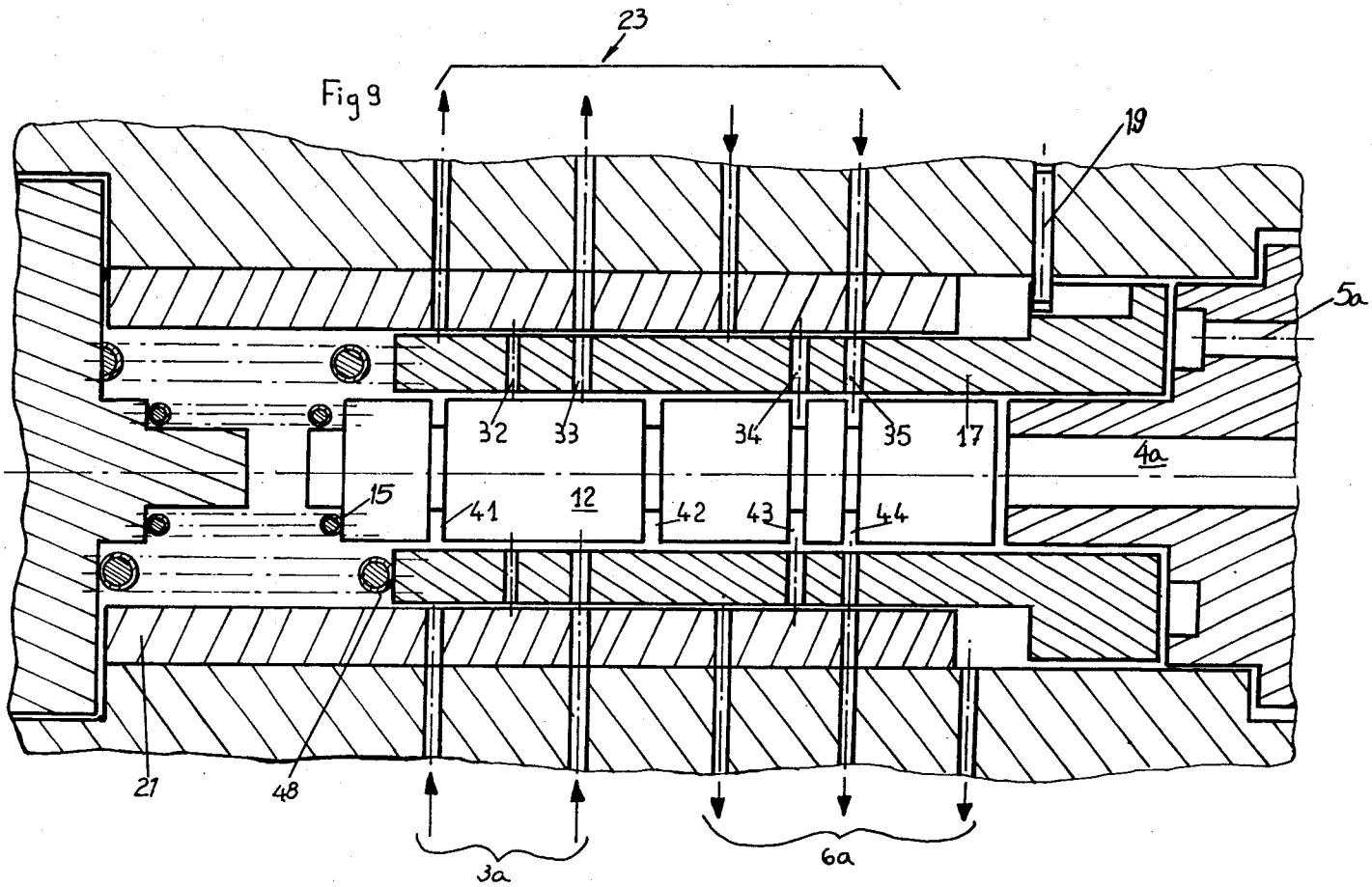
FIGS. 9 to 11 are views similar to FIGS. 6 to 8 but illustrating modifications therefrom.

In the alternate example of structure illustrated in FIG. 9, the central slide valve 12 and the movable sleeve 17 are not used to control the movement of the needle of the injector 2, but rather to pass the portion of the fuel injected directly into the cylinder head. In this variant, the closing of the needle of the injector cannot be assisted.

Figure 10:
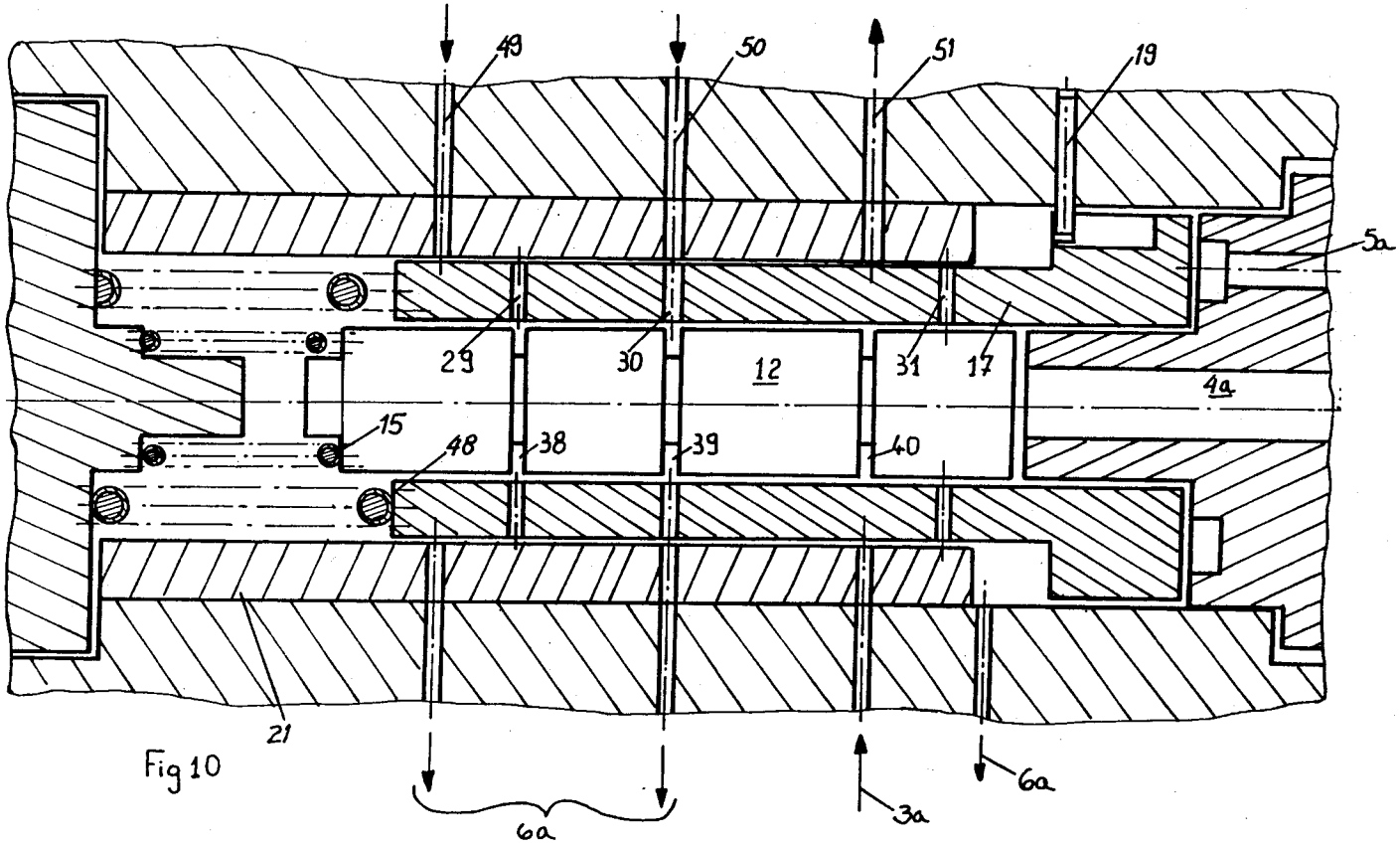

The alternate example of structure shown in FIG. 10 is used when the rapidity of the injection frequency is not critical. In this case, it is provided that the central slide valve 12 and the movable sleeve 17 describe a back and forth motion for each injection cycle. This leads to a simplified system having only three bores 49, 50 and 51 connected to the line 23. This example is appropriate for certain slow motors or when it is desirable to integrate the double casing 12–17 with the injector nozzle holder 1. The start of injection is defined by motion of the movable sleeve 17.

Figure 11:
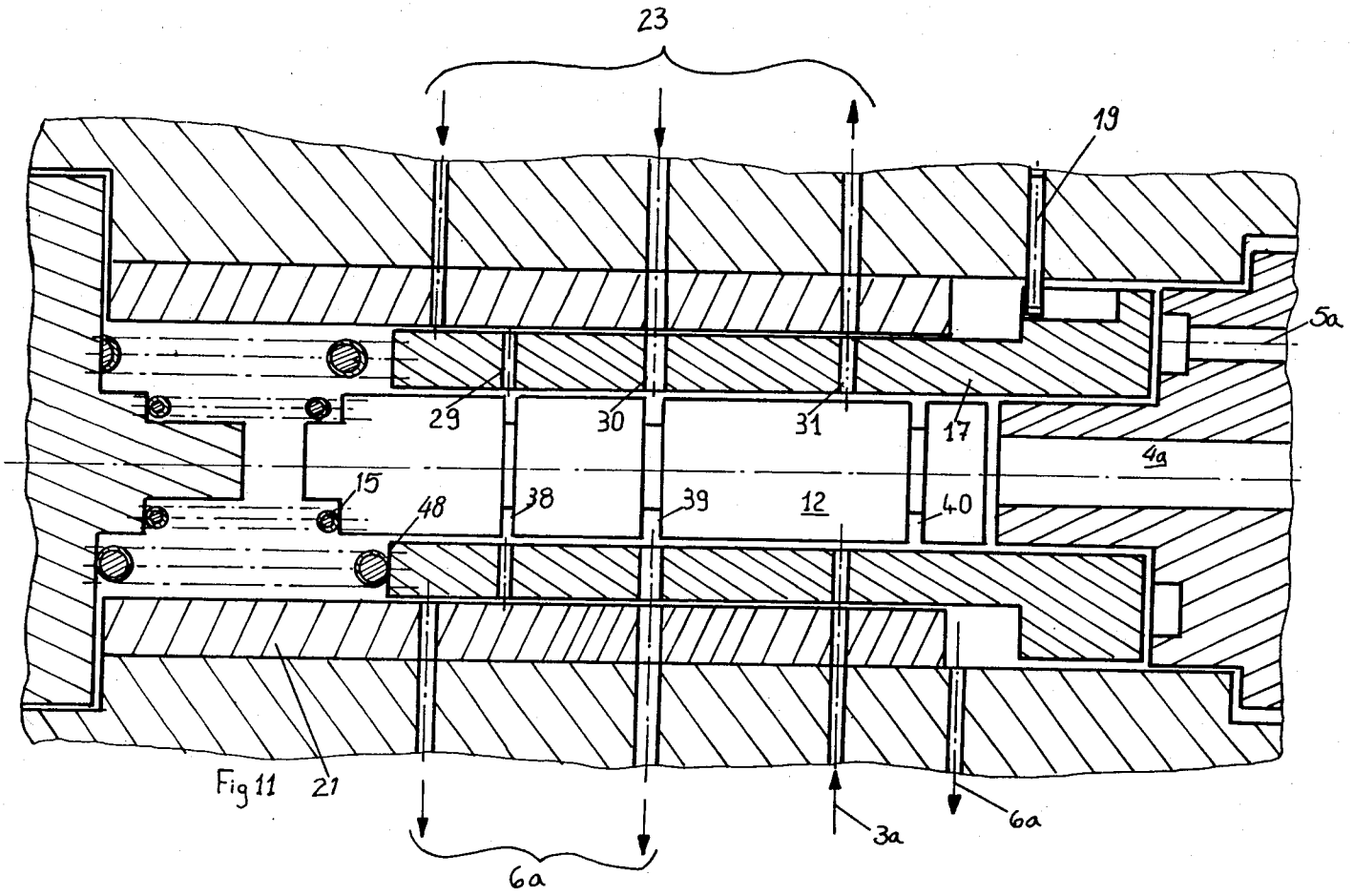

In the example of structure shown in FIG. 11, the start of injection is defined by the central slide valve 12, while it is the movable sleeve 17 which defines the end of injection. In fact, since the movable sleeve 17 has a larger annular section, the slide valve 12 may be moved in a more rapid motion, which may be of interest for certain types of motors.

Of course it would not be going beyond the scope of the invention to combine as desired the different possibilities illustrated in the variants of FIGS. 6 to 11. Moreover the driving of the slide valve 12 and of the movable sleeve 17 may equally well be electronic or mechanical instead of the hydraulic drive shown in FIG. 1.

Having thus described the present invention by means of a detailed description of the best mode contemplated at the time of filing, variations and modifications will be apparent to those skilled in the art, and are included within the intended scope of the present invention.

What is claimed as novel is as follows:

1. A device for controlling the start and end of a fuel injection cycle for a fuel injector responsive to pressure in a chamber on one side of said fuel injector, said device comprising:

a housing;

a bore in said housing;

a first valve member comprising a sleeve valve member movably disposed in said bore, said sleeve valve member being movable between a first and a second extreme position;

first biasing means biasing said sleeve valve member into said first extreme position;

first drive means selectively operable to drive said sleeve valve member into said second extreme position against the force of said first biasing means;

a second valve member comprising a cylindrical valve member movably disposed in said sleeve valve member, said second valve member being movable independently of said first valve member between a first and a second extreme position;

second biasing means biasing said cylindrical valve member into said first extreme position;

second drive means selectively operable to drive said cylindrical valve member into said second extreme position against the force of said second biasing means;

a first passageway in said housing extending from said chamber to said bore;

a second passageway in said housing extending from said bore to an external portion of said housing for interconnection with a source of pressurized fuel;

a third passageway in said housing extending from said bore to an external portion of said housing for interconnection with a fuel return means;

a fourth passageway through both said first valve member and said second valve member selectively interconnecting said first passageway with said third passageway when said first valve member and said second valve member are in respective preselected ones of said extreme positions; and a fifth passageway through both of said first valve member and said second valve member selectively interconnecting said first passageway with said second passageway when a preselected one of said valve members is in its respective preselected extreme position and the other of said valve members is in the extreme position opposite its respective preselected position.

2. The device of claim 1 further comprising a sixth passageway through both of said first and second valve members selectively interconnecting said first passageway with said second passageway when said other valve member is in its respective preselected extreme position and said one valve member is in the extreme position opposite its respective preselected position.

3. The device of claim 2 further comprising a seventh passageway through both of said valve members selectively interconnecting said first passageway with said third passageway when both of said first and second valve members are in the extreme positions opposite their respective preselected extreme positions.

4. The device of claim 1 further comprising a seventh passageway through both of said valve members selectively interconnecting said first passageway with said third passageway when both of said valve members are in the extreme positions opposite their respective preselected extreme positions.

5. The device of claim 1 wherein the portion of said fourth and fifth passageways extending through said sleeve valve member each comprises a radial bore through said sleeve valve member.

6. The device of claim 5 wherein the portion of said fourth and fifth passageways extending through said cylindrical valve member each comprises an annular channel about said cylindrical valve member and each is selectively registerable with one of said radial bores in said sleeve valve member.

7. The device of claim 1 wherein the portion of said fourth and fifth passageways extending through said cylindrical valve member each comprises an annular channel about said cylindrical valve member.

8. The device of claim 1 wherein said first drive means comprises a first drive chamber and said second drive means comprises a second drive chamber, each of said first and second drive chambers being adjacent one end of said respective first and second valve members such that each of said first and second drive chambers is selectively pressurized to drive one of said sleeve valve member and said cylindrical valve member.

9. The device of claim 8 further comprising calculator means selectively generating first and second pressure pulses in said first and second drive chambers, respectively, to regulate the injection timing of said fuel injector.

10. The device of claim 1 further comprising calculator means selectively generating first and second signals to respectively actuate said first and second drive means.

11. The device of claim 10, further comprising a sixth passageway through both of said first and said second valve members selectively interconnecting said first passageway with said second passageway when said other valve member is in its respective preselected extreme position and said one valve member is in the extreme position opposite its respective preselected position.

12. The device of claim 11 further comprising a seventh passageway through both of said first and said second valve members selectively interconnecting said first passageway with said third passageway when both of said valve members are in the extreme positions opposite their respective preselected extreme positions.

13. The device of claim 12 wherein each of said fourth, fifth, sixth, and seventh passageways comprise a bore in said sleeve valve member and an annular channel in said cylindrical valve member.

14. A method of controlling injection timing of a fuel injector for supplying fuel to an internal combustion engine, the fuel injector having an injector nozzle holder, and an injector, said method comprising the steps of:

generating a first signal corresponding to initiation of an injection cycle;

transmitting said first signal to a first valve member movably disposed in said injector nozzle holder, said first valve member being movable between a first predetermined extreme position and a second predetermined extreme position;

generating a second signal corresponding to termination of an injection cycle;

transmitting said second signal to said a second valve member, said second valve member being movable between a first predetermined extreme position and a second predetermined extreme position;

moving said first valve member from said first predetermined extreme position to said second predetermined extreme position in response to said first signal relative to said second valve member and relative to said injector nozzle holder to bring a plurality of first predetermined passageways through said first and second valve members and said injector nozzle holder into registry to initiate an injection cycle;

moving said second valve member relative to said first valve member and relative to said injector nozzle holder in response to said second signal from said first predetermined extreme position to said second predetermined extreme position to bring a plurality of second predetermined passageways through said first and second valve members and said injector nozzle holder into registry to terminate an injection cycle;

generating a third signal corresponding to initiation of a second injection cycle after said step of moving said second valve member;

transmitting said third signal to said first valve member;

moving said first valve member in response to said third signal from said second predetermined extreme position to said first predetermined extreme position to bring third predetermined passageways through said first and second valve members and said injector nozzle holder into registry to initiate said second injection cycle;

generating a fourth signal corresponding to termination of said second injection cycle; and transmitting said fourth signal to said second valve member and moving said second valve member in response to said fourth signal from said second predetermined extreme position to said first predetermined extreme position to bring fourth predetermined passageways through said first and second valve members and said injector nozzle holder into registry to terminate an injection cycle.

15. A method of controlling injection timing of a fuel injector for supplying fuel to an internal combustion engine, the fuel injector having an injector nozzle holder, and an injector, said method comprising the steps of:

generating a first signal corresponding to initiation of an injection cycle;

transmitting said first signal to a first valve member movably disposed in said injector nozzle holder, said first valve member being movable between a first predetermined extreme position and a second predetermined extreme position;

generating a second signal corresponding to termination of an injection cycle;

transmitting said second signal to a second valve member, said second valve member being movable between a first predetermined extreme position and a second predetermined extreme position, one of said first valve member and said second valve member comprising an annular sleeve member reciprocably disposed in a bore in said injector nozzle holder and the other of said first valve member and said second valve member comprising a cylindrical valve member reciprocably disposed within said annular sleeve member;

moving said first valve member between said first predetermined extreme and said second predetermined extreme position in response to said first signal relative to said second valve member and relative to said injector nozzle holder to bring a plurality of first predetermined passageways through said first and second valve members and said injector nozzle holder into registry to initiate an injection cycle; and moving said second valve member relative to said first valve member and relative to said injector nozzle holder in response to said second signal from said first predetermined extreme position to said second predetermined extreme position to bring a plurality of second predetermined passageways through said first and second valve members and said injector nozzle holder into registry to terminate an injection cycle.

16. A method of controlling injection timing of a fuel injector for supplying fuel to an internal combustion engine, the fuel injector having an injector nozzle holder, and an injector, said method comprising the steps of:

generating a first signal corresponding to initiation of an injection cycle, said first signal being an hydraulic pressure pulse;

transmitting said first signal to a first valve member movably disposed in said injector nozzle holder;

moving said first valve member in response to said first signal relative to a second valve member and relative to said injector nozzle holder to bring first predetermined passageways through said first and second valve members and said injector nozzle holder into registry to initiate an injection cycle;

generating a second signal corresponding to termination of an injection cycle, said second signal being an hydraulic pressure pulse;

transmitting said second signal to said second valve member; and moving said second valve member relative to said first valve member and relative to said injector nozzle holder in response to said second signal to bring second predetermined passageways through said first and second valve members and said injector nozzle holder into registry to terminate an injection cycle.

17. A method of controlling injection timing of a fuel injector for supplying fuel to an internal combustion engine, the fuel injector having an injector nozzle holder, and an injector, said method comprising the steps of:

generating a first signal by an electronic computer corresponding to initiation of an injection cycle;

transmitting said first signal to a first valve member movably disposed in said injector nozzle holder;

moving said first valve member in response to said first signal relative to a second valve member and relative to said injector nozzle holder to bring first predetermined passageways through said first and second valve members and said injector nozzle holder into registry to initiate an injection cycle;

generating a second signal by an electronic computer corresponding to termination of an injection cycle;

transmitting said second signal to said second valve member; and moving said second valve member relative to said first valve member and relative to said injector nozzle holder in response to said second signal to bring second predetermined passageways through said first and second valve members and said injector nozzle holder into registry to terminate an injection cycle.

18. A method of controlling injection timing of a fuel injector for supplying fuel to an internal combustion engine, said fuel injector having an injector nozzle holder, and an injector, said method comprising the steps of:

generating a first signal corresponding to initiation of an injection cycle;

transmitting said first signal to a first valve member movably disposed in said injector nozzle holder;

moving said first valve member in response to said first signal relative to a second valve member and relative to said injector nozzle holder to bring a plurality of first predetermined passageways through said first and second valve members and said injector nozzle holder into registry to initiate an injection cycle;

generating a second signal corresponding to termination of an injection cycle;

transmitting said second signal to said second valve member; and moving said second valve member relative to said first valve member and relative to said injector nozzle holder in response to said second signal to bring a plurality of second predetermined passageways through said first and second valve members and said injector nozzle holder into registry to terminate an injection cycle.

19. The method of claim 18 wherein said first valve member and said second valve member are both movable between a first predetermined extreme position and a second predetermined extreme position and wherein said first and second signals move said first valve member and said second valve member between said first and second predetermined extreme positions.

20. The method of claim 19 wherein said step of moving said first valve member comprises moving said first valve member from said first predetermined extreme position to said second predetermined extreme position and wherein said step of moving said second valve member comprises moving said second valve member from said first predetermined extreme position to said second predetermined extreme position.

* * * * *